US006304209B1

(12) United States Patent
Noda

(10) Patent No.: US 6,304,209 B1
(45) Date of Patent: Oct. 16, 2001

(54) ELECTROMAGNETIC WAVE ABSORBER IN BROAD BANDS

(75) Inventor: Kennichi Noda, Nagoya (JP)

(73) Assignee: Ten Co., Ltd., Nagoya (JP)

( * ) Notice: Subject to any disclaimer, the term of this patent is extended or adjusted under 35 U.S.C. 154(b) by 0 days.

(21) Appl. No.: 09/484,568

(22) Filed: Jan. 18, 2000

(30) Foreign Application Priority Data

Jan. 18, 1999 (JP) ..... 11-008681

(51) Int. Cl.[7] ..... H01Q 17/00
(52) U.S. Cl. ..... 342/4; 342/1
(58) Field of Search ..... 342/1–12

(56) References Cited

U.S. PATENT DOCUMENTS 3,151,324 * 9/1964 McMillan ..... 342/4

* cited by examiner

*Primary Examiner*—Bernarr E. Gregory
(74) *Attorney, Agent, or Firm*—Frishauf, Holtz, Goodman, Langer & Chick, P.C.

(57) ABSTRACT

The present invention relates to an electromagnetic wave absorbers in broad bands, which can be efficiently produced by a simple method, thereby reducing production costs, and for which working efficiency can be improved due to a reduction in weight. The absorber is capable of efficiently absorbing electromagnetic waves in broad bands. The electromagnetic wave absorber in broad bands is constructed by attaching sintered ferrite magnetic bodies, in which lattice bar portions are disposed at appointed intervals, to a metallic reflection plate. The lattice bar portions of the sintered ferrite magnetic bodies are such that sintered ferrite plates of an appointed thickness are formed curved at a base width and a height where openings are provided at the respective bases of the lattice bar portions, so that the interval between openings are gradually made narrow from the base to the upper end and the top parts are caused to converge to a width almost coincident with the thickness of said sintered ferrite plate. Spacing formed at the bases of the lattice bar portions is made into a dielectric layer.

8 Claims, 7 Drawing Sheets

ELECTROMAGNETIC WAVE ABSORBER IN BROAD BANDS

FIELD OF THE INVENTION

The present invention relates to an electromagnetic wave absorber in broad bands, which prevents TV electric waves and microwaves from being reflected by electric wave darkrooms, which measure electromagnetic waves transmitted from electronic devices, and buildings.

BACKGROUND OF THE INVENTION

As shown in FIG. 9(*a*) and (*b*) of Japanese Patent Application No. 3-239147, such an electromagnetic absorber in broad bands has been publicly known as the abovementioned electromagnetic absorber for broad bands, wherein sintered ferrite magnetic bodies attached on a metallic reflection plate are such that, in respective lattice bar portions each having an interval of an appointed width, a plurality of absorbing portions having a rectangular shape in its section, the lateral widths of which are different from each other, are laminated in multi-stages and integrally molded so that the lateral widths thereof become smaller from the base to the upper end.

That is, it is necessary that the thickness of a sintered ferrite magnetic body is established in compliance with a frequency of electromagnetic waves to be absorbed, in detail, $\lambda/4$, wherein, in order to enable electromagnetic absorption in broad bands, sintered ferrite magnetic bodies whose thickness is established for each of the frequency bands are combined to construct an electromagnetic wave absorber.

The sintered ferrite magnetic bodies are produced by baking a ferrite material, in which Ni-Zn ferrite powder or Mn-Zn ferrite powder are blended with a binder, after molding the same in the form of the multistage lattice in a press-molding process. However, since the sintered ferrite magnetic body is of a complicated shape having an undercut portion, it is difficult to draw the sintered ferrite magnetic body from a mold in the press-molding process, wherein the ratio of defectives was high.

And, in order to correspond to various types of frequency bands, it is necessary that the electromagnetic wave absorber has a plurality of absorbing portions, whose lateral widths are different from each other, laminated in multi-stages. Therefore, it is unavoidable that the weight of the electromagnetic wave absorber is increased, whereby construction efficiency thereof was remarkably low when attaching such electromagnetic wave absorbers to an electric wave darkroom or a building, etc., Further, where electromagnetic waves are brought into contact with the planes of the respective absorbing portions at a low incident angle, and since, in the electromagnetic wave absorbers for broad bands, the respective absorbing portions of the lattice bar portions are formed flat or plane, some part of the electromagnetic waves are reflected, wherein the ratio of electromagnetic permeation is low, and the electromagnetic wave absorption efficiency was unsatisfactory.

It is therefore an object of the invention to provide an electromagnetic wave absorber in broad bands, which can be efficiently produced by a simple method and resultantly can reduce production cost thereof.

It is another object of the invention to provide an electromagnetic wave absorber in broad bands having a reduced weight, for which working efficiency is excellent.

It is still another object of the invention to provide an electromagnetic wave absorber having an excellent ratio of electromagnetic wave absorption.

PREFERRED EMBODIMENTS

Figure 1:
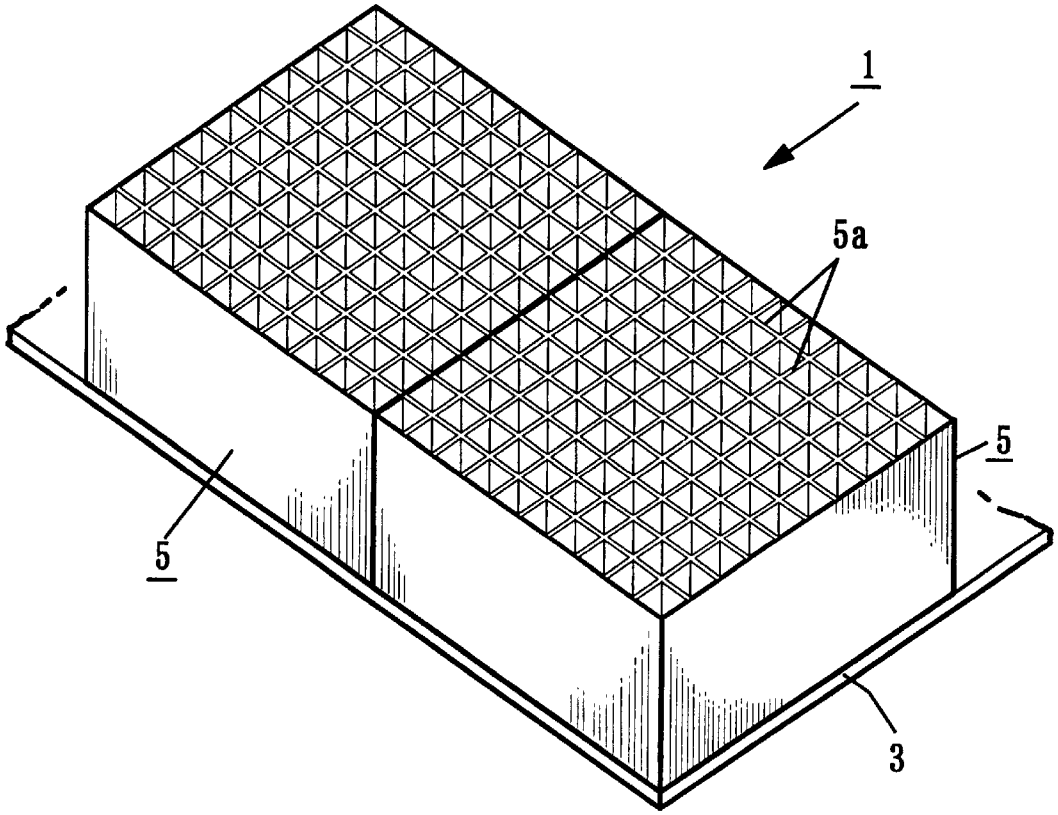
FIG. 1 is a general perspective view of an electromagnetic wave absorber in broad bands.
Figure 2:
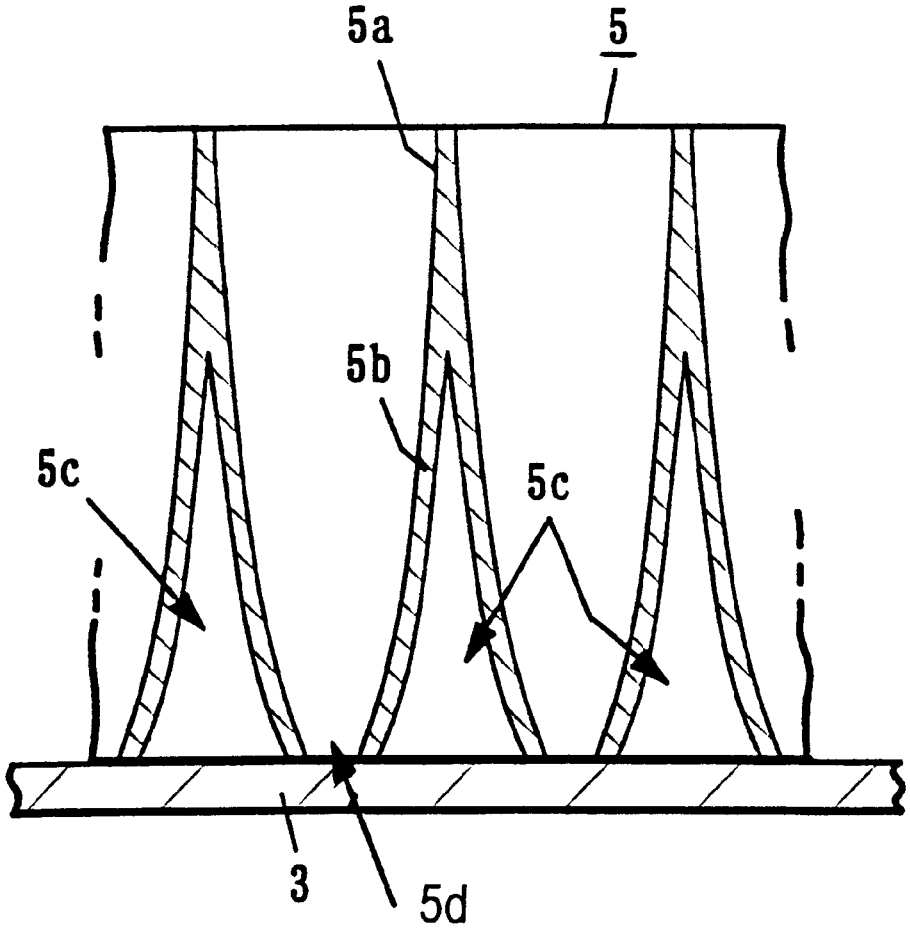
FIG. 2 is a longitudinally sectional view taken along the line II—II in FIG. 1.
Figure 3:
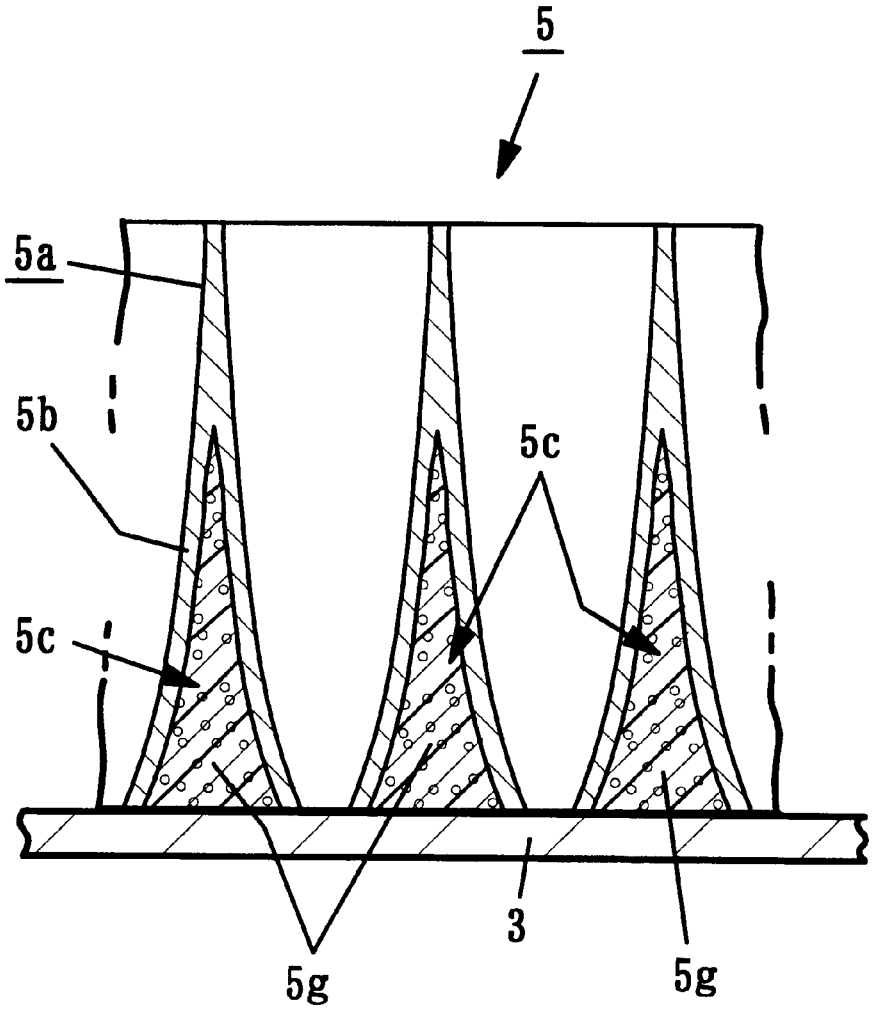
FIG. 3 is a longitudinally sectional view of a modified embodiment of an electromagnetic absorber in broad bands.
Figure 4:
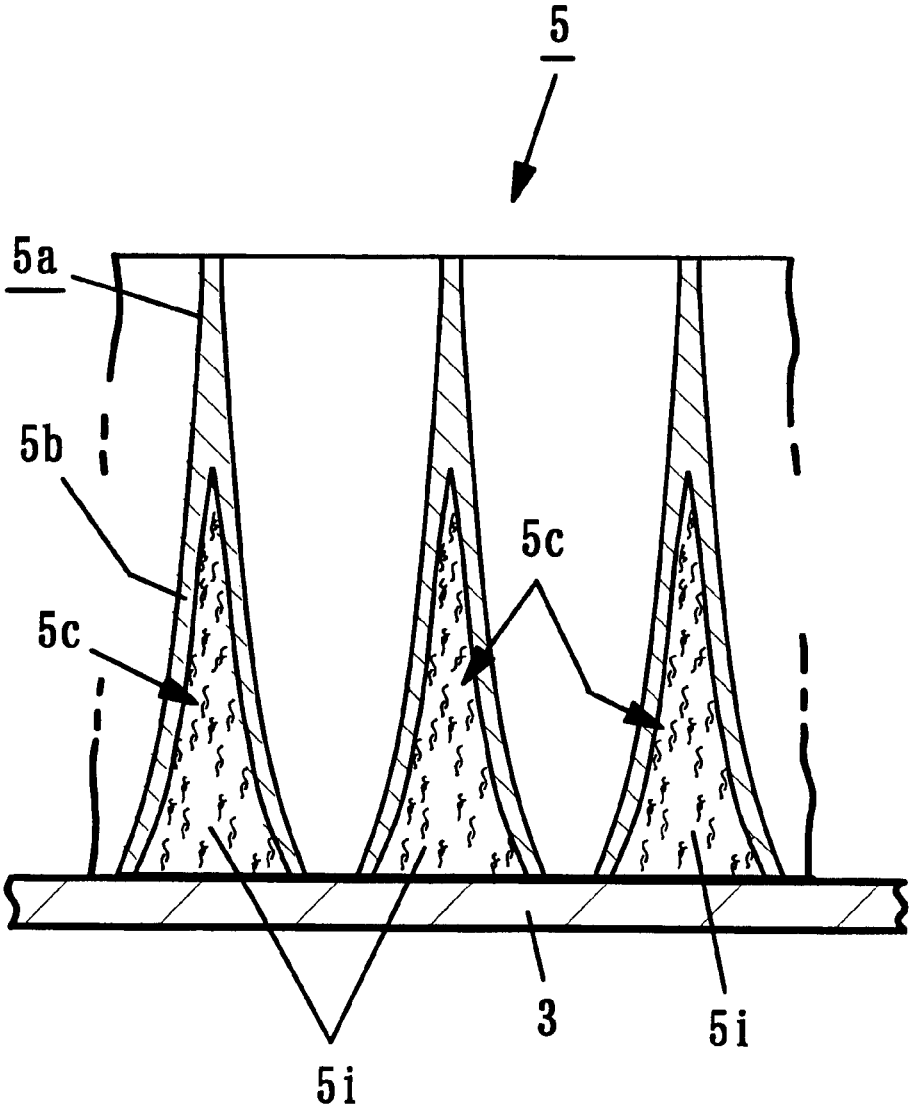
FIG. 4 is a longitudinally sectional view of another modified embodiment of an electromagnetic absorber in broad bands.
Figure 5:
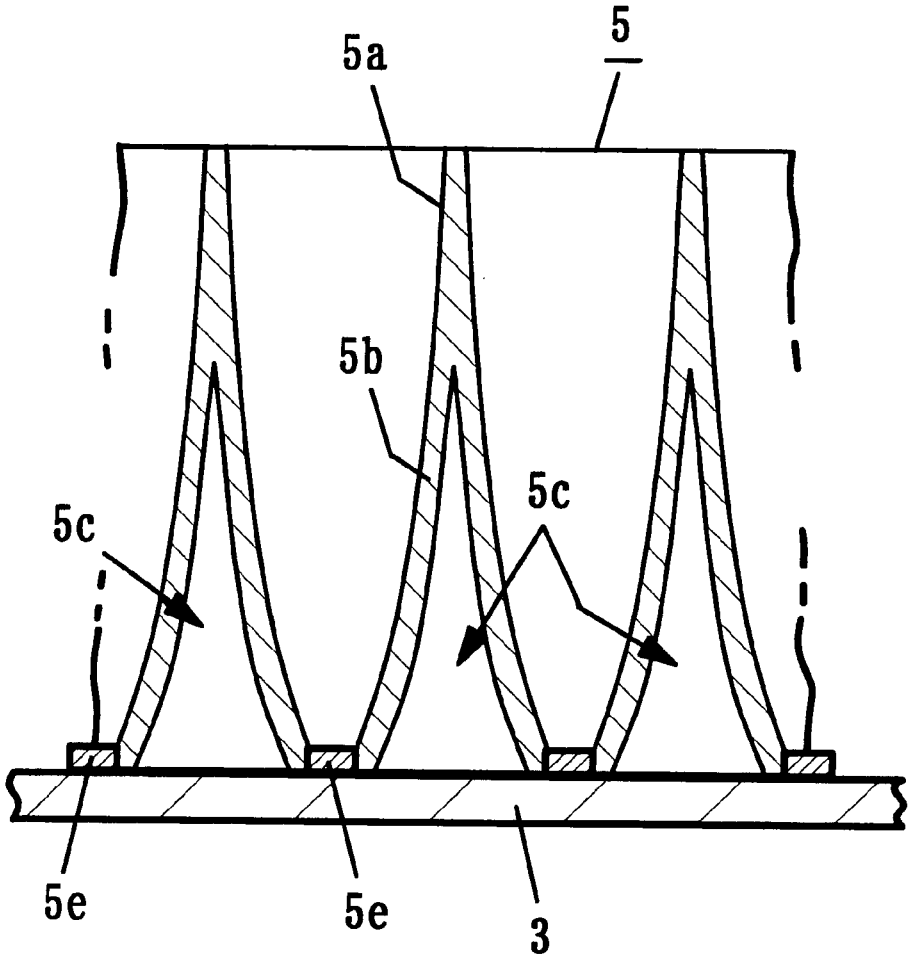
FIG. 5 is a longitudinally sectional view of still another modified embodiment of an electromagnetic absorber in broad bands.

Hereinafter, a description is given of embodiments with reference to the accompanying drawings.

In FIG. 1 through FIG. 5, an electromagnetic wave absorber 1 in broad bands is of an appointed rectangle, which is composed of a metallic plate, having a thickness of approx. 1 through 5 mm, such as an iron plate, a steel plate, or an aluminum plate, etc., and a sintered ferrite magnetic body 5 attached to the metallic plate 3.

The sintered ferrite magnetic body 5 is in the form of a lattice in which lattice bar portions 5*a* are disposed at appointed intervals, wherein the respective lattice bar portions 5*a* are formed concave and curved, so that absorbing plates 5*b* having a thickness of approximately 2 mm are disposed so that their top portion widths become approximately 10 mm, their heights become approximately 65 to 100 mm, and their base portion widths become approximately 2 mm, wherein the mutual widths between the respective lattice bar portions are gradually made smaller from the base portions thereof to the top portions thereof. Spacing portions 5*c* which constitute dielectric layers are formed from the base to the intermediate portion in the height direction inside the respective lattice bar portions 5*a*.

The sintered ferrite magnetic body 5 is made of sintered ferrite baked after press-molding a raw material, in which Ni—Zn ferrite powder or Mn—Zn ferrite powder is blended with a binder, to the abovementioned shape. Also, the spacing portions 5*c* are to form a dielectric layer of an electromagnetic wave absorber 1 in broad bands, wherein a foamed resin material 5*g* (foamed styrene resin, foamed urethane resin shown in FIG. 3), organic or inorganic fibers, or fibrous assemblies 5*i* (shown in FIG. 4) in which various synthetic resin fibers are combined together, may be filled in the spacing portions 5*c*.

Figure 6:
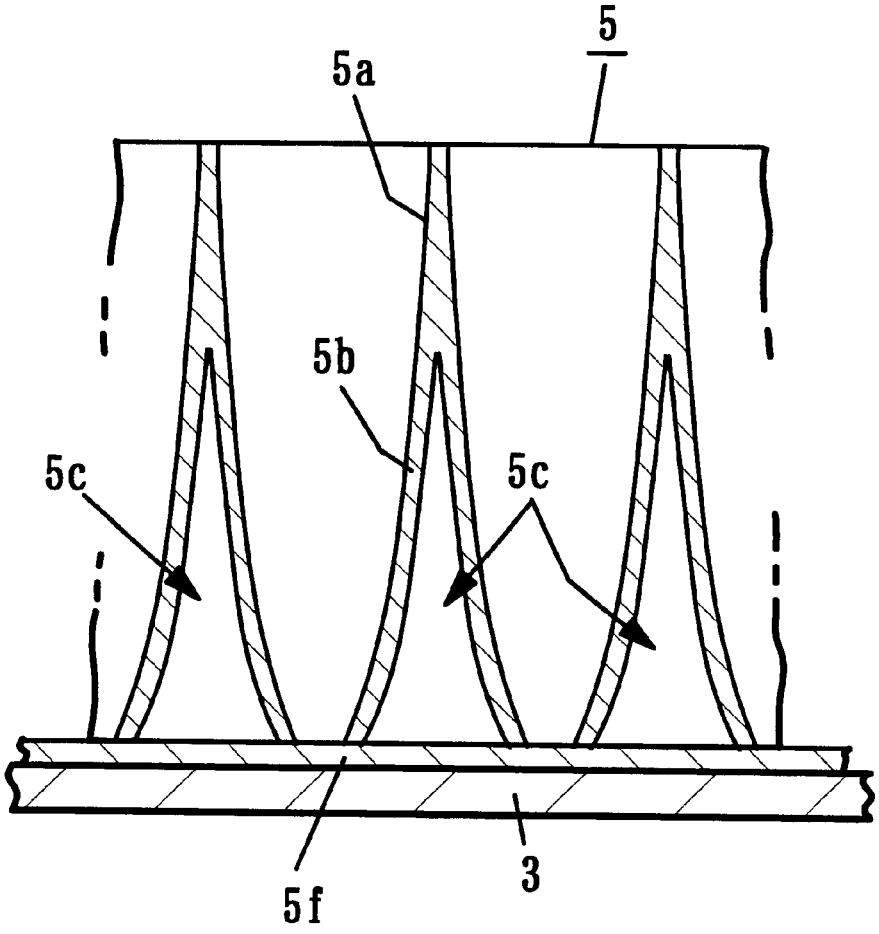
FIG. 6 is a longitudinally sectional view of further another modified embodiment of an electromagnetic absorber in broad bands.

An opening portion 5*d* (shown in FIG. 2) of approx. 5 mm square is formed at the base of the respective lattice bar portions 5*a* at the sintered ferrite magnetic body 5. In a case where the corresponding electromagnetic wave absorber 1 in broad bands is attached to and used for an electric wave darkroom, an attenuation ratio of −15 dB or more (absorption ratio: approx. 90% or more) is required as an electromagnetic wave absorbing characteristic. In applications where an electromagnetic wave absorption characteristic exceeding the above ratio is required, a sintered ferrite plate 5*e* (shown in FIG.5) of 1 through 5 mm thick is inserted into the opening 5*d* or a sintered ferrite plate 5*f* (shown in FIG. 6) is attached to the entire upper surface of a metallic reflection plate 3, and thereafter a sintered ferrite magnetic body 5 may be provided.

A description is given of an electromagnetic wave absorbing action of the electromagnetic wave absorber 1 in broad bands, which is constructed as described above.

As for electromagnetic waves of, for example, comparatively low frequency bands (approx. 30 Mhz through 1 GHz), electromagnetic waves irradiated onto the absorbing plate 5*b* of the respective lattice bar portions 5*a* are partially converted to thermal energy due to magnetic permeation with respect to the absorbing plate 5*b* and absorbed, and the electromagnetic waves permeated through the absorbing plate 5*b* without being converted to thermal energy are reflected to the incident side by the metallic reflection plate 3, wherein the electromagnetic waves again permeate the absorbing plate 5*b* and are converted to thermal energy. Thereby, electromagnetic waves can be absorbed.

On the other hand, as for electromagnetic waves of comparatively high frequency (approx. 1 GHz through 40 GHz), as described above, the electromagnetic waves are partially absorbed in line with permeation with respect to the absorbing plate 5*b,* and the electromagnetic waves permeated through the corresponding absorbing plate 5*b* are absorbed by dielectric losses when transmitting in an air layer in the spacing portion 5*c*. Thereafter, the electromagnetic waves are reflected to the incident side by the metallic reflection plate 3, and are absorbed by permeating the absorbing plate 5*b* while being subjected to dielectric losses in the spacing portion 5*c* as in the above description. Subsequently, non-absorbed electromagnetic waves are again reflected by the lattice bar portions 5*a* and are absorbed through multiple reflections between the absorbing plate 5*b* and metallic reflection plate 3.

Since the corresponding absorbing plates 5*b* are formed concave and curved, the irradiation angle of electromagnetic waves incident in the absorbing plates 5*b* can be made greater than in the case wherein the absorbing plates 5*b* are flat or plane. Therefore, most of the electromagnetic waves irradiated on the outer surface of the absorbing plates 5*b* are caused to permeate the absorbing plates 5*b* and can be absorbed. Also, as regards an electromagnetic wave absorber 1 in broad bands shown in FIG. 4, electromagnetic waves which are subjected to dielectric losses in line passing through the spacing portions 5*c* are partially converted to thermal energy when permeating a sintered ferrite plate 5*e* and absorbed there. Thereafter, the electromagnetic waves are further reflected by the metallic reflection plate 3 and absorbed through multiple reflection in the lattice bar portions 5*a,* whereby the absorption ratio can be increased.

Thereby, an electromagnetic wave absorber 1 in broad bands is capable of absorbing electromagnetic waves at an attenuation ratio of −15 dB or more in wide frequency bands of approx. 30 MHz through 40 GHZ described above.

In the preferred embodiment, the respective lattice bar portions 5*a* of the sintered ferrite magnetic body 5 are formed concave and curved, and are free from any undercut portions. Therefore, mold release can be easily carried out, thereby improving production efficiency. Further, since the electromagnetic wave absorber 1 is structured so as to have spacing portions 5*c* in the respective lattice bar portions 5*a,* the weight of the sintered ferrite magnetic body 5 itself can be reduced, and working efficiency can be further improved when attaching the electromagnetic wave absorber to an electric wave darkroom or a building, etc. Further, since the spacing portions 5*c* constitute dielectric layers, electromagnetic waves of high frequency bands can be absorbed by dielectric losses, whereby applications in broad bands are enabled. Still further, since the lattice bar portions 5*a* are formed concave and curved, the incident angle of electromagnetic waves with respect to the lattice bar portions 5*a* can be increased to increase the ratio of permeation into the absorbing plates 5*b,* thereby improving the electromagnetic wave absorption efficiency.

Figure 7:
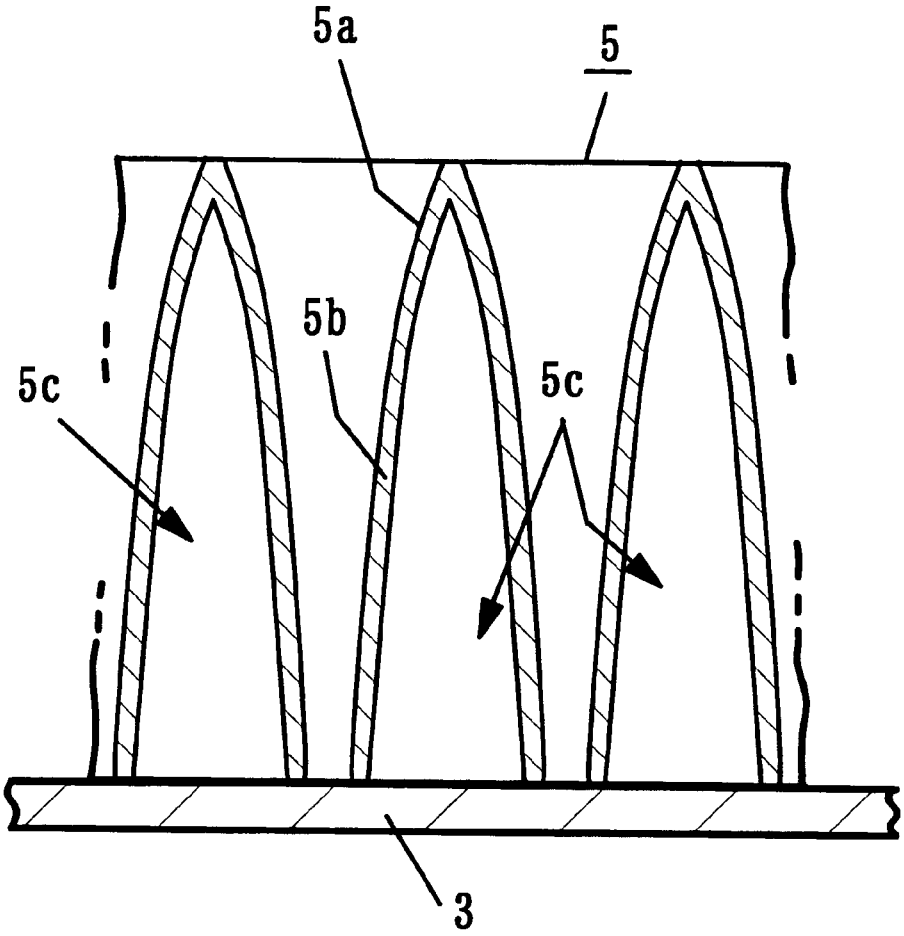
FIG. 7 is a longitudinally sectional view of further another modified embodiment of an electromagnetic absorber in broad bands.

Although, in the preferred embodiment, the sides of the respective lattice bar portions 5*a* are formed concave and curved upward, they may be formed so as to be projected and curved as shown in FIG. 7. In this case, the electromagnetic wave absorber in broad bands may be modified and embodied as in the above preferred embodiment.

What is claimed is:

1. An electromagnetic wave absorber in broad bands comprising:

at least one sintered ferrite magnetic body having lattice bar portions disposed at regular intervals; and a metallic reflection plate to which said at least one sintered ferrite magnetic body is attached;

wherein the lattice bar portions comprise sintered ferrite plates of a thickness responsive to a frequency of electromagnetic waves to be absorbed;

wherein the sintered ferrite plates are curved so that openings between the lattice bar portions are gradually made narrow from top portions of the sintered ferrite plates to base portions of the sintered ferrite plates, and so that the openings between the lattice bar portions converge to a width almost coincident with the thickness of said sintered ferrite plates; and wherein a dielectric layer is provided in respective spacings between the sintered ferrite plates at said base portions of the sintered ferrite plates outside the openings between the lattice bar portions.

2. An electromagnetic wave absorber in broad bands as set forth in claim 1, wherein additional sintered ferrite plates are provided between the sintered ferrite plates at said base portions of the sintered ferrite plates inside the openings between the lattice bar portions.

3. An electromagnetic wave absorber in broad bands as set forth in claim 1, wherein the at least one sintered ferrite magnetic body is attached to the metallic reflection plate with an additional sintered ferrite plate disposed therebetween.

4. An electromagnetic wave absorber in broad bands as set forth in any one of claims 1 through 3, wherein outer sides of the sintered ferrite plates of the lattice bar portions are concave and curved from the base portions of the sintered ferrite plates to the top portions of the sintered ferrite plates.

5. An electromagnetic wave absorber in broad bands as set forth in any one of claims 1 through 3, wherein outer sides of the sintered ferrite plates of the lattice bar portions are projected and curved from the base portions of the sintered ferrite plates to the top portions of the sintered ferrite plates.

6. An electromagnetic wave absorber in broad bands as set forth in any one of claims 1 through 3, wherein the dielectric layer comprises an air layer.

7. An electromagnetic wave absorber in broad bands as set forth in any one of claims 1 through 3, wherein the dielectric layer comprises a foamed synthetic resin material.

8. An electromagnetic wave absorber in broad bands as set forth in any one of claims 1 through 3, wherein the dielectric layer comprises a fibrous assembly.

* * * * *